US005098283A

United States Patent [19]

Clapp

[11] Patent Number: 5,098,283

[45] Date of Patent: Mar. 24, 1992

[54] COMBUSTION METHOD FOR COMBUSTING A PRESSURIZED FUEL

[75] Inventor: Clarence P. Clapp, Milford, Conn.

[73] Assignee: Creative Products Inc. of Rossville, Rossville, Ill.

[21] Appl. No.: 537,018

[22] Filed: Jun. 13, 1990

Related U.S. Application Data

[60] Continuation of Ser. No. 280,891, Dec. 7, 1988, abandoned, which is a division of Ser. No. 179,607, Apr. 11, 1988, abandoned.

[51] Int. Cl.[5] ..... F23D 14/02

[52] U.S. Cl. ..... 431/11; 431/232; 431/247; 431/344; 585/14; 126/39 R; 126/39 G; 126/43; 126/93

[58] Field of Search ..... 431/11, 344, 206, 232, 431/247, 6; 126/39 R, 39 G, 43, 44, 93, 95; 222/3, 6; 585/6, 14

[56] References Cited

U.S. PATENT DOCUMENTS

| | | | |
|---|---|---|---|
| 1,176,172 | 3/1916 | Schleusselburg | 126/43 |
| 2,683,484 | 7/1954 | Falligant | 585/14 X |
| 3,409,076 | 11/1968 | Quiring | 431/247 |
| 4,078,540 | 3/1978 | Hou | 431/247 X |
| 4,177,040 | 12/1979 | Kaiser, Jr. | 44/52 |
| 4,261,700 | 4/1981 | Monick | 44/34 |
| 4,521,181 | 6/1985 | Delage | 431/247 X |

FOREIGN PATENT DOCUMENTS

| | | | |
|---|---|---|---|
| 2106695 | 5/1972 | France | 585/6 |

*Primary Examiner*—Carl D. Price
*Attorney, Agent, or Firm*—Victor E. Libert

[57] ABSTRACT

The invention provides a combustion device such as a stove which may include a pressurized fuel mixture, such as an aerosol container containing alcohol and a propellant which may comprise a normally gaseous hydrocarbon, such as a liquified petroleum gas. The propellant and air are fed to a combustion zone as a combustion mixture, which is combusted therein in a cold start period to pre-heat the liquid fuel and vaporize it. When the liquid fuel is vaporized by the heat provided by combusting the propellant gas, combustion is continued by combusting the vaporized liquid, e.g., alcohol, fuel. The pressurized fuel composition may comprise a major proportion of alcohol together with a minor proportion of the hydrocarbon propellant starter fuel. The method therefore includes carrying out an initial, cold-start phase of combustion utilizing the propellant as fuel, and a subsequent stage of combustion utilizing the vaporized liquid fuel. Propellant gas, if any, dissolved in or otherwise carried over with the liquid fuel may also be combusted during the subsequent stage of combustion.

11 Claims, 4 Drawing Sheets

95b
95
94a
97
94b
94
95a
97a
106
104
101
114a
110
68
g
98
114
96
102
104a
69
100a
116
112
68d
99
100
108

COMBUSTION METHOD FOR COMBUSTING A PRESSURIZED FUEL

This is a continuation of copending application Ser. No. 07/280,891, filed on Dec. 7, 1988, now abandoned, which is a divisional application of copending application Ser. No. 07/179,607, filed on Apr. 11, 1988, now abandoned.

BACKGROUND OF THE INVENTION

The present invention is concerned with a combustion apparatus and a method for combusting a pressurized fuel, and with fuel mixtures for such combustion. More particularly, the present invention is concerned with combustion devices, e.g., space heaters, stoves and the like, of the type which have, or can be connected to, a self-contained fuel supply. With the prior art devices, such self-contained fuel supply may be propane gas cylinders or other containerized fuels. Such combustion devices are portable in the sense that their fuel supply is self-contained and are conveniently used in environments such as outdoors (by military units, by explorers, hikers or other campers), on board boats, and the like. Such combustion devices are sometimes referred to below as "self-contained" devices, combustion devices, stoves, etc.

Such self-contained combustion devices adapted to burn a variety of fuels are well known in the art. Alcohol is a particularly advantageous fuel for such self-contained devices because of its low explosion hazard and stability in transport and storage, the absence of suffocating fumes and generally low danger level in case of leakage of the fuel. Generally, liquid fuels have certain advantages over gaseous fuels for use with self-contained combustion devices because the explosion hazard associated with pressurized gas cylinders is avoided, liquid fuel is denser and therefore requires less storage volume per unit of heat energy available, and may be more readily available in the field.

Whether the fuel employed is alcohol, a hydrocarbon fuel such as kerosene, or any other suitable liquid fuel, a difficulty encountered in portable or lightweight stoves and the like is the difficulty of providing smooth, reliable combustion of the liquid fuel in a self-contained device which often must be lightweight or portable. The usual solution is to vaporize the liquid fuel and admix the vaporized fuel with air to provide a combustion mixture. Once the self-contained device is in operation, the liquid fuel can be readily vaporized by heating it from the combustion it is fueling, as by passing the fuel through a pre-heating tube or coil positioned to be heated by the combustion. However, vaporization of the fuel presents a problem in cold starts, because a preliminary heat source must be provided to vaporize the fuel. The art has expended considerable effort and ingenuity in attempting to overcome these and related problems.

RELATED ART

Hou U.S. Pat. No. 4,078,540 discloses a kerosene vapor stove in which (FIG. 8, col. 3, lines 34–40) liquid kerosene is pressurized by compressed air and admitted (FIG. 2) through a valve 2 and line 6 into an electrically preheated coil 11 for pre-heating sufficient to vaporize the kerosene. Needle valve 13 is then opened to admit vaporized kerosene into a mixing tube 15 in which the kerosene vapor/air mixture is ignited to burn on burner 16 (FIGS. 1 and 7.) The valve 2 is then shifted to reroute the kerosene supply through tube 7 and looped tube 20, which is heated by burner 16 to vaporize the kerosene. (FIG. 3, column 3, lines 38–55.) Valve 18 feeds a supplemental burner 19 which is used to avoid the need for electrical pre-heating for re-starting. (Column 2, lines 26–29).

Kun-Ming U.S. Pat. No. 4,106,914 shows a liquid hydrocarbon fuel tank including a built-in air compressor controlled by a pressure-sensitive switch. Compressed air together with heat generated by a light bulb heats the kerosene to vaporize it, and the resultant air-kerosene vapor mixture is transmitted via outlet 123 to a stove.

Palmer et al U.S. Pat. No. 3,376,100 discloses (FIG. 2) a self-contained combustion apparatus in which liquid fuel (alcohol) is gravity fed from a container 11 to a vaporizer 22 located above the main burner 18*b* for heating to vaporize the liquid. Liquid fuel is initially supplied via conduit 50 to a starting burner 24 which initially heats the vaporizer 22, (column 3, line 38 et seq.) and may be shut off after the flame appears at main burner 18*b* (column 3, lines 52–55). A portion of the vaporized fuel is fed through conduit 17 back to the fuel tank 11 to equalize the pressure and permit gravity feed of the liquid alcohol. A check valve 17*a* may be included in conduit 17 to prevent sloshing or back-feeding of liquid fuel.

White, Jr. et al U.S. Pat. No. 3,703,166 provides a self-contained combustion device having a fuel tank (for kerosene, gasoline or the like, column 2, lines 62–66) of annular shape surrounding a centrally positioned burner. In operation, as explained starting at column 4, line 42, the burner flame is started with liquid fuel and serves to directly heat the fuel contained within the main tank to vaporize some of it to feed the burner. Expansion voids 21 and 18*a* (FIG. 4, column 2, line 49 et seq.) are provided to accommodate thermal expansion of fuel in hope of thereby preventing the heated fuel "from bursting the tank walls". The danger of rupturing the heated fuel tank by direct heating is thus explicitly acknowledged.

SUMMARY OF THE INVENTION

The present invention provides a method of combusting a pressurized fuel mixture, and a combustion device for combusting the fuel mixture, which method and device serve to overcome certain problems inherent in the prior art devices. Generally, the method of the invention comprises carrying out an initial stage of combustion during a cold start period by utilizing the flammable propellant gas as a gaseous fuel and using the heat of combustion thereby obtained to vaporize the liquid fuel and combust the vaporized liquid fuel in a subsequent stage of combustion. Generally, the combustion device of the invention includes a heat exchanger and means to initially conduct the flammable, gaseous propellant to the combustion zone and combusted therein to supply heat to the heat exchange zone, and in a subsequent stage of combustion conduct the liquid fuel through the heat exchange zone for vaporization therein and then conduct the vaporized liquid fuel to the combustion zone for the subsequent stage of combustion.

In accordance with the present invention, there is provided a combustion device for a normally liquid fuel, the device comprising the following components: a supply conduit having an inlet connectable to a source of liquid fuel pressurized by a flammable, normally gaseous propellant, the supply conduit extending in series flow communication from its inlet to a heat exchange zone, thence to a combustion zone, the heat exchange and combustion zones being disposed in heat exchange relationship with each other; valve means associated with the supply conduit to control flow through the supply conduit; and control means operatively associated with the valve means to switch the valve means between (i) a first operating position in which gaseous propellant is admitted into the combustion zone for combustion therein to transfer heat of combustion to the heat exchange zone, and (ii) a second operating position in which liquid fuel is admitted to the heat exchange zone for vaporization therein, and the resultant fuel vapor is admitted to the combustion zone for combustion therein.

In one aspect of the invention, the device includes a source of liquid fuel, e.g., an alcohol, pressurized by a flammable, normally gaseous propellant, e.g., a hydrocarbon, contained under superatmospheric pressure in a gas space acting on the liquid fuel, the source comprising a pressure-resistant container having a discharge opening connected in flow communication to the inlet of the supply conduit.

In accordance with another aspect of the invention, there is provided a combustion device for a pressurized liquid fuel, the device comprising the following components: an inlet conduit is connected in liquid flow communication to a liquid-vapor separator having a liquid receptacle and a vapor space, the inlet conduit (i) being fitted with an inlet nozzle dimensioned and configured to connect the conduit in flow communication to a pressurized fuel container containing a liquid fuel pressurized by a flammable, normally gaseous propellant, and (ii) including a heat-exchange section between the inlet nozzle and the liquid-vapor separator; a combustion zone disposed in heat exchange relationship with the heat-exchange section whereby heat generated in the combustion zone heats fuel flowing through the heat-exchange section; a vapor conduit connecting the vapor space but not the liquid receptacle of the separator in flow communication with the combustion zone; and valve means in the flow path of the inlet conduit to control the flow of fuel into the separator.

In one aspect of the invention, the foregoing device may include a pressure-resistant fuel container having a discharge opening connected in flow communication to the feed nozzle, and containing a liquid fuel pressurized by a flammable, normally gaseous propellant at superatmospheric pressure.

Another aspect of the present invention provides a method for combusting a pressurized fuel, the method comprising the following steps: providing a pressurized fuel mixture comprised of a normally liquid fuel, e.g., alcohol, and a flammable, normally gaseous propellant, e.g., a hydrocarbon, which is at least sufficiently soluble in the fuel to provide a flammable gas as described below; at least during a cold start period, (i) passing the pressurized fuel mixture to a reduced pressure zone to therein vaporize propellant from the fuel to provide therefrom a flammable gas, (ii) mixing the resultant flammable gas with combustion air to provide a start-up combustion mixture, and (iii) combusting the start-up combustion mixture in a combustion zone; passing the pressurized fuel mixture to a heat exchange zone and heating it therein to vaporize the normally liquid fuel and provide therefrom a fuel vapor and, at least during the cold start period, using heat obtained from step (iii) for thus heating the liquid fuel; and mixing the fuel vapor with combustion air to provide a primary combustion mixture, and combusting the primary combustion mixture in the combustion zone.

Yet another aspect of the invention provides a method for combusting a pressurized fuel, the method comprising the following steps; providing a pressurized fuel mixture comprised of a normally liquid fuel, e.g., alcohol, and a flammable, normally gaseous propellant, e.g., a hydrocarbon, at least part of which is maintained as a gas at superatmospheric pressure within a gas space to pressurize the liquid fuel; at least during a cold start period, (i) passing a portion of the propellant to a combustion zone, (ii) mixing the passed propellant with combustion air to provide a start-up combustion mixture, and (iii) combusting the start-up combustion mixture in a combustion zone; passing the liquid fuel to a heat exchange zone and heating it therein to vaporize the normally liquid fuel and provide therefrom a fuel vapor and, at least during the cold start period, using heat obtained from step (iii) for thus heating the liquid fuel; and mixing the resultant fuel vapor with combustion air to provide a primary combustion mixture, and combusting the primary combustion mixture in the combustion zone.

Other method aspects of the invention include, subsequent to the cold start period, using heat obtained from combusting the primary combustion mixture to vaporize the liquid fuel.

Still other aspects of the invention will be apparent from the following description.

DETAILED DESCRIPTION OF THE INVENTION AND PREFERRED EMBODIMENTS THEREOF

Figure 1:
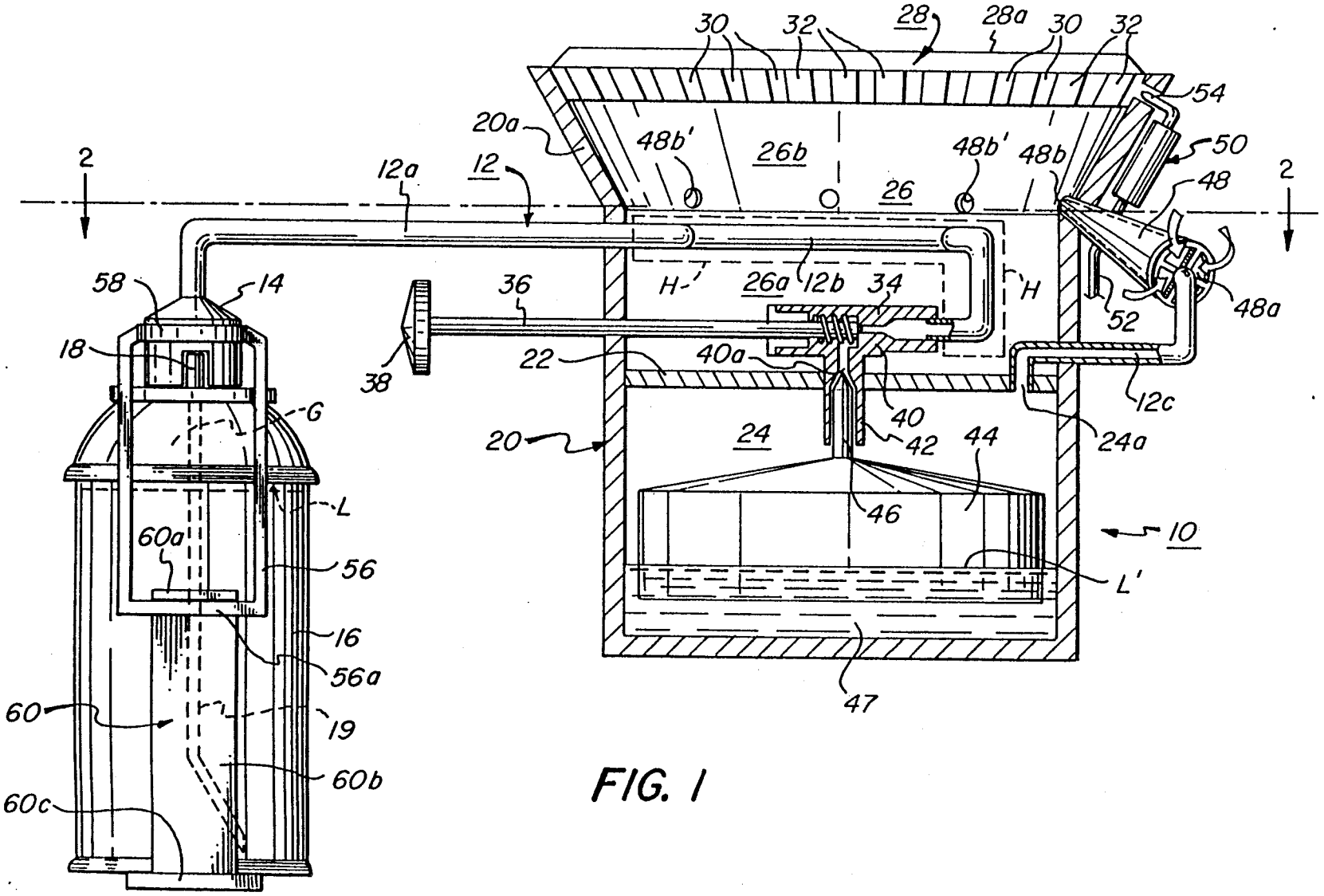
FIG. 1 is a schematic elevation view partly in cross section of a combustion device in accordance with one embodiment of the present invention and including a source of pressurized fuel connected thereto.

Referring now to the drawings, FIG. 1 shows a combustion device comprising a stove generally indicated at 10 which includes a supply conduit 12 having an inlet nozzle 14 connected to a source of liquid fuel comprising a pressure-resistant container 16. Container 16 may comprise an ordinary aerosol-type container conventionally used in commerce as a container from which a wide variety of liquids may be dispersed. Such pressure-resistant aerosol type containers containing a pressurized fuel for use in self-contained stoves or other combustion devices are commercially available. Container 16 contains therein a liquid fuel, such as an alcohol, the level of which within container 16 is indicated by dash line L. A gas space G above the level L contains a flammable, propellant gas, such as a hydrocarbon gas maintained under superatmospheric pressure, so that the pressure of the propellant gas within gas space G will, when stem valve 18 is depressed, force the liquid fuel within container 16 through liquid dip-leg 19 through a discharge opening (not shown in FIG. 1) within stem valve 18 thence through inlet nozzle 14 in supply conduit 12. The structure of container 16 including the liquid dip-leg and a depressable stem valve 18 having a discharge opening therein is conventional and well-known in the art.

Combustion device 10 comprises a cylindrical body portion 20 which is divided by a wall 22 into a liquid-vapor separator 24 and a combustion zone 26 comprised of a lower, cylindrical-shaped combustion zone section **26*a* and a truncated cone-shaped upper combustion zone section 26*b* is defined by an inverted, truncated cone-shaped segment 20*a* of body 20. Segment 20*a* supports at its upper end a flame grill 28 which is of conventional construction and has a plurality of flame passages 30 formed about the periphery thereof by a plurality of spaced-apart lands 32. Flame grill 28 is thus of conventional construction and serves to provide a ring of individual flames dispersed about the periphery thereof, in the conventional manner to facilitate the heating of cooking pots and the like. A spoked support means (not shown in the drawings) may be fitted above flame grill 28 in the conventional manner to provide a support for cooking pots and the like spaced from the top surface 28*a* of flame grill 28**.

Figure 2:
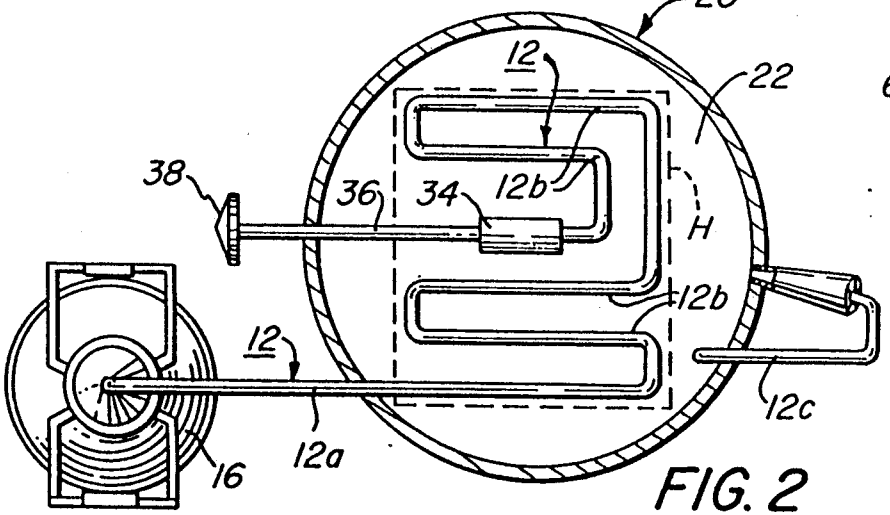
FIG. 2 is a section view in reduced scale relative to FIG. 1, taken along line 2—2 of FIG. 1.

As best appreciated by referring jointly to FIGS. 1 and 2, supply conduit 12 seem to be comprised of an inlet **12*a*, a heat exchange section 12*b* generally comprising that portion of conduit 12 which is contained within the area designated by the dash line H in FIGS. 1 and 2, and a vapor conduit 12*c*. In the illustrated embodiment, inlet conduit 12*a* and heat exchange section 12*b* connect container 16 in flow communication with liquid-vapor separator 24 and vapor conduit 12*c* connects the vapor space of liquid-vapor separator 24 in flow communication with combustion zone 26**, as more fully described below.

Heat exchange section **12*b* is connected at its discharge end to a valve 34 comprising, in the illustrated embodiment, an adjustable needle valve fitted with a control rod 36 having an adjustment knob 38 affixed at the distal end thereof. As shown in FIG. 1, control rod 36 is threadably received within the body of valve 34 to adjust the size of the effective flow opening of the L-shaped passage 40 extending through the body of valve 34. The vertical (as viewed in FIG. 1) leg of L-shaped passage 40 leads to an outwardly flared wide passage 40*a* contained within leg 42 of valve 34. A float 44 carries at the top center thereof a needle plunger 46 which is received within the flared passage 40*a* of the vertical leg of L-shaped passage 40. Condensed liquid fuel 47 is contained within the lower portion of liquid-vapor separator 24, the lower portion of which comprises a liquid receptacle. The level L′ of condensed liquid fuel within liquid-vapor separator 24 determines the elevation of float 44, which floats on liquid fuel 47, and thereby of needle plunger 46 within flared passage 40*a***.

Vapor conduit **12*c* extends from an opening 24*a* in wall 22 thence to a mixing cone 48 having air openings 48*a* surrounding the discharge end of vapor conduit 12*c*, which is supported at a central point of the air openings 48*a* by suitable spoke-like supporting structures (unnumbered). Mixing cone 48 terminates in an air inlet 48*b* leading to combustion zone 26. Supplemental air inlets 48*b*′ are also provided spaced about the periphery of body 20 adjacent the juncture of cone-shaped segment 20*a* to the cylindrical portion of body 20**.

An igniter 50 may comprise any suitable igniter means, such as a piezoelectric lighter connected to a suitable activator by a wire lead 52 and having an igniter tip 54 disposed in or adjacent to one of the flame passages 30 provided at the periphery of flame grill 28.

Container 16 may be connected to inlet nozzle 14 in any convenient manner. FIG. 1 illustrates one such mounting bracket means as comprising a pair of rectangular-shaped loops 56 (only one of which is visible in FIG. 1) depending from a circular mounting ring 58 seated on a shoulder formed about the periphery of inlet nozzle 14. A second one of the loops 56 is disposed diametrically opposite to loop 56, and so is not visible in FIG. 1. The loops may be permanently affixed to inlet nozzle 14 and have arms **56*a* which are dimensioned and configured to engage respective ones of a pair of mounting lips 60*a* formed at the opposite distal ends of a U-shaped clamp bracket 60 comprised of a pair of arms 60*b*, only one of which is visible in FIG. 1, the second arm 60*b* being diametrically opposite that illustrated in the drawing. The two arms 60*b* are connected by a bight portion 60*c* which has a short coil spring or other suitable means (not shown in FIG. 1) affixed thereto to engage the bottom of pressure-resistant container 16 when the latter is placed within clamp bracket 60. Compression of the coil spring will force mounting lips 60*a* downwardly against arms 56*a* of loops 56 thereby retaining container 16 in place and causing inlet nozzle 14 to bring pressure to bear on stem valve 18, thereby holding stem valve 18** constantly in the open or discharging position.

When stove 10 is not in use, knob 38 will be turned to a closed position (suitable indicia, not shown, may be associated with knob 38 to indicate its position as off or on and, optionally, to indicate the degree of opening such as low, medium and high). When it is desired to operate the stove from a cold start, valve 34 is opened which will cause the liquid fuel to be forced upwardly through dip-leg 19 thence through inlet conduit **12*a*, heat exchange section 12*b* thereof and through valve 34 and leg 42 into liquid-vapor separator 24. In this embodiment of the invention, the gaseous propellant utilized is one which is sufficiently soluble in the liquid fuel that propellant gas dissolved in the fuel will vaporize as it enters the atmospheric pressure environment provided by liquid-vapor separator 24. Liquid fuel will fall to the bottom or liquid receptacle portion of separator 24 whereas the flammable propellant gas will pass through vapor conduit 12*c* thence to mixing cone 48 and into combustion zone 26. Air is aspirated as indicated by the unnumbered arrows in FIG. 1 through the openings 48*a* of mixing cone 48 to combine with the flammable propellant vapors to form a combustion mixture within combustion zone 26. The combustion mixture is ignited by any suitable means, either by using the igniter 50 to generate a spark at igniter tip 54 or by inserting a flame, such as match, through one of the auxilliary air inlets 48b' in order to ignite the combustion mixture. Once combustion is established within combustion zone 26, the heat thereof will heat the liquid fuel passing through the conduit comprising heat exchange section 12b so that after the initial starter period, a fuel vapor comprised of vaporized liquid fuel will be introduced into liquid-vapor separator 24 and will pass through vapor conduit 12c into mixing cone 48. As stove 10 continues in operation, the temperature will rise within liquid-vapor separator 24** thereby vaporizing some or all of the liquid fuel contained therein.

Wall 22 is made of a heat conductive material, such as steel or aluminum, and body 20 itself is optionally and preferably made of a heat conductive material so that the heat of combustion being carried out within combustion zone 26 will maintain liquid-vapor separator 24 at an elevated temperature to vaporize liquid fuel contained therein. If the level of liquid fuel within liquid-vapor separator 24 becomes sufficiently high, it will raise float 44 high enough to force needle plunger 46 upwardly to close off the passage of additional fuel through valve 34 into liquid separator 24. Combustion needs will then be supplied by liquid fuel vaporized from liquid-vapor separtor 24 and as this liquid fuel supply is diminished, float 44 will sink thereby admitting into the vapor space of liquid-vapor separator 24 additional fuel, which will be in the form of a fuel vapor having been retained in heat exchange section 12b while needle plunger 46 was positioned to attenuate or block entry of fuel into liquid-vapor separator 24.

It will be appreciated that the schematic illustration of FIG. 1 omits numerous conventional and useful features, such as a frame or bracket within which to retain both combustion device 10 and pressure-resistant fuel container 16. For example, combustion device 10 may conveniently be retained within a thermal insulating enclosure to protect the user and the surroundings from the high temperatures to which the body 20 is heated during combustion in combustion zone 26. A thermal insulating shield may also be provided between pressure-resistant fuel container 16 and combustion device 10, and a mounting bracket or receptacle within which fuel container 16 is retained is conveniently attached to or formed as part of the enclosure containing device 10. A suitable support may be provided as part of such enclosure, or as an accessory therefor to support cooking pans and the like immediately above flame grill 28, as briefly noted above.

With the conventional pressure-resistant container 16 illustrated in FIG. 1, the propellant gas utilized must be sufficiently soluble in the liquid fuel so that a sufficient amount of it is dissolved in the fuel which is transported via conventional liquid dip-leg 19 and the supply conduit 12 to liquid-vapor separator 24 to separate therein and provide a vapor fuel for an initial stage of combustion, some of the heat of combustion of which is then utilized to vaporize the liquid fuel itself.

Figure 3C:
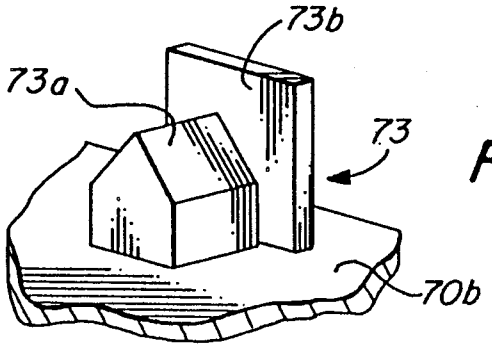
FIG. 3C is a perspective view with parts broken away of a positioning block comprising a component of the container mounting bracket of FIG. 3.
Figures 3, 3A, 3B:
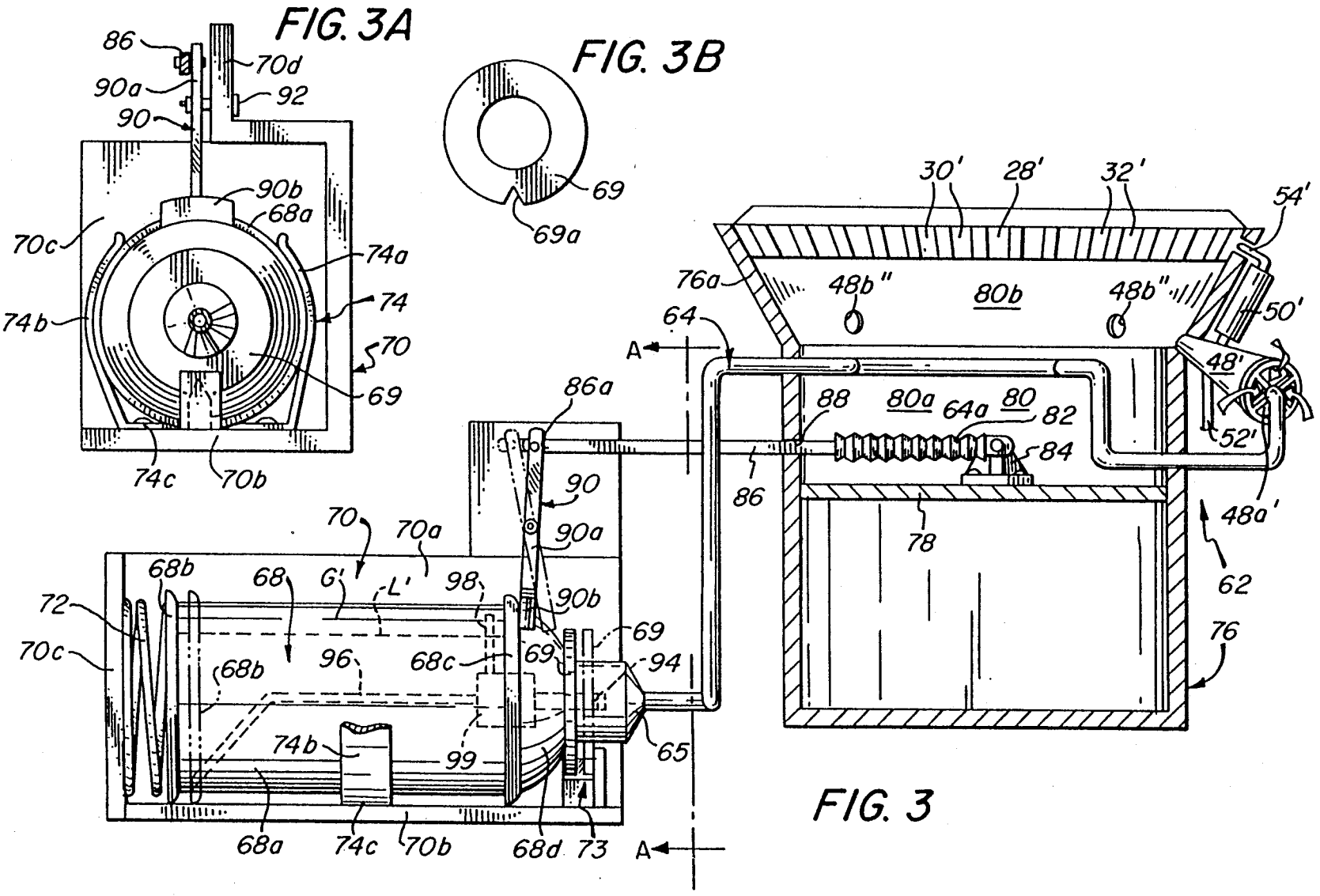
FIG. 3 is a schematic elevation view partly in cross section of a combustion device in accordance with another embodiment of the present invention and including a source of pressurized fuel connected thereto.
FIG. 3A is an elevation view taken along line A—A of FIG. 3.
FIG. 3B is a plan view with parts broken away of a component of the fuel container of FIGS. 3 and 3A.

However, with a pressure-resistant container of the type illustrated in FIG. 3, it is not necessary that the propellant be soluble in the liquid fuel, because means are provided to initially convey only the propellant gas to the combustion zone and ignite it therein and, after this initial cold start stage, to transport the liquid fuel to the combustion zone via a heat exchange zone in which the liquid fuel is vaporized to provide it to the combustion zone in the form of a fuel vapor.

Referring now to FIG. 3, there is shown another embodiment of the invention comprising a combustion device comprising a stove generally indicated at 62 which includes a supply conduit 64 having an inlet nozzle 65 connected to a source of liquid fuel, the source comprising a pressure-resistant fuel container 68 which, like container 16, may comprise an ordinary aerosol-type container which is modified by being equipped with a dual-acting valve as described in more detail below. Inlet nozzle 65 is dimensioned and configured to receive therein the valve stem 94 of fuel container 68. Valve stem 94 has a discharge conduit 95 therein to provide flow communication between container 68 and supply conduit 64, as described in detail below. Container 68 has a central, cylindrical body portion 68a, which extends between its base rim 68b and its shoulder rim 68c, and a neck portion 68d which extends from its shoulder rim 68c and is surmounted by a positioning collar 69. Collar 69 is of generally circular, ring-shaped configuration and has a wedge-shaped cutout 69a in the outer periphery thereof, as best seen in FIG. 3B. Positioning collar 69 is affixed to the top of container 68 by any suitable means, such as spot welding, crimping or otherwise securely fastening it to the topmost portion (as viewed in FIG. 4) of neck portion 68d of container 68. Positioning collar 69 has a central aperture (unnumbered) formed therein to admit passage therethrough of stem portion 94a. Container 68 is positioned horizontally and retained within a mounting bracket 70 having a side wall 70a, a base 70b, a back wall 70c and an L-shaped support bracket 70d which extends transversely of fuel container 68 above the longitudinal center line of pressure-resistant fuel container 68, as best seen in FIG. 3A. A biasing means comprising a coil spring 72 (FIG. 3) is affixed to the inside of back wall 70c to be engaged and compressed by fuel container 68 as described below.

A resilient U-shaped container bracket 74 has a pair of opposed arms 74a, 74b extending from a bight section 74c which is secured to the top surface of base 70b. Arms 74a, 74b are resilient and spring-like and are normally spaced apart from each other a distance somewhat less than the diameter of fuel container 68 so that upon inserting fuel container 68 therebetween, the arms are spread apart and engage the container with a resilient, gripping force.

Stove 62 has a body portion 76 which is similar or identical to body portion 20 of the stove illustrated in FIG. 1. Thus, a cylindrical body portion 76 is divided by a wall 78 to provide a combustion zone 80 comprised of a lower, cylindrical-shaped combustion zone section 80a and a truncated cone-shaped upper combustion zone section 80b defined by an inverted, truncated cone-shaped segment 76a of body 76. Segment 76a supports at its upper end a flame grill 28' of the same construction as flame grill 28 of the FIG. 1 embodiment, having a plurality of flame passages 30' formed about the periphery thereof by a plurality of spaced-apart lands 32'. A mixing cone 48', supplementary air inlets 48b'', an igniter 50' having an igniter tip 54' and a lead 52', are each identical to the embodiment described with respect to FIG. 1 and, accordingly, the description thereof is not repeated here.

In contrast to the embodiment of FIG. 1, the stove 62 of FIG. 3 does not contain a liquid-vapor separator but, rather, the portion of body 76 below wall 78 may simply comprise an enclosed space. Alternatively, it may be eliminated altogether or replaced by simple legs or a support frame. However, it is to be understood that in an alternate embodiment of the invention, the stove of FIG. 3 could also be provided with a liquid-vapor separator equipped with a float valve, etc., in the same manner as illustrated in FIG. 1, to provide for receiving and subsequently vaporizing any liquid fuel which might pass through heat exchange section 64a and not be vaporized therein. In such case, the portion of supply conduit 64 leading into mixing cone 48' would be connected in flow communication with the liquid-vapor separator in a manner identical or similar to that illustrated in FIG. 1 with respect to vapor conduit 12c.

A thermal expansion/contraction device 82 is mounted within lower section 80a of combustion zone 80 by means of a support pedestal 84. Device 82 may comprise any conventional device, such as a bellows-like device, which expands to a pre-determined extent at a given temperature range; such devices are well known in the art and need not be further described herein. A push rod 86 is connected to the end of device 82 opposite the end which is supported by pedestal 84 and extends through an aperture 88 provided in the wall of body portion 76. Push rod 86 has a distal end 86a which is pivotably connected to a retaining bar 90 having an arm 90a and a retaining paddle 90b. At approximately its midpoint, arm 90a is pivotably mounted on a fulcrum pin 92 which is carried in support bracket 70d. Retaining paddle 90b is dimensioned and configured to engage a shoulder rim 68c of fuel container 68 so that, when stove 62 is cold and thermal expansion/contraction device 82 is consequently in its contracted state as shown in solid lines in FIG. 3, push rod 86 will be in its retracted position relative to body 76 and will retain container 68 in compressing contact with coil spring 72, resisting the biasing force of spring 72 which tends to urge fuel container 68 rightwardly (as sensed in FIG. 3) to the position illustrated by the dash-line rendition of base rim 68b and positioning collar 69. (For clarity of illustration, only base rim 68b and positioning collar 69 are rendered in dash line to indicate the shifted position of container 68.)

The level of liquid fuel, e.g., alcohol, within fuel container 68 is indicated at L' and the gas space above the fuel, containing the normally gaseous propellant, e.g., a hydrocarbon, is indicated by G'. A dip-leg 96 has its distal, inlet end submerged within the liquid at or adjacent the lowest portion of container 68. A propellant gas line 98 extends upwardly (as viewed in FIG. 3) and has its distal, inlet end disposed near the upper reaches of the gas space G', well above the highest level L' of liquid fuel. Both dip-leg 96 and propellant line 98 are connected in flow communication to the body 100 of a dual-acting valve 99. Valve 99 is indicated schematically in dash-line outline in FIG. 3.

Figure 4:
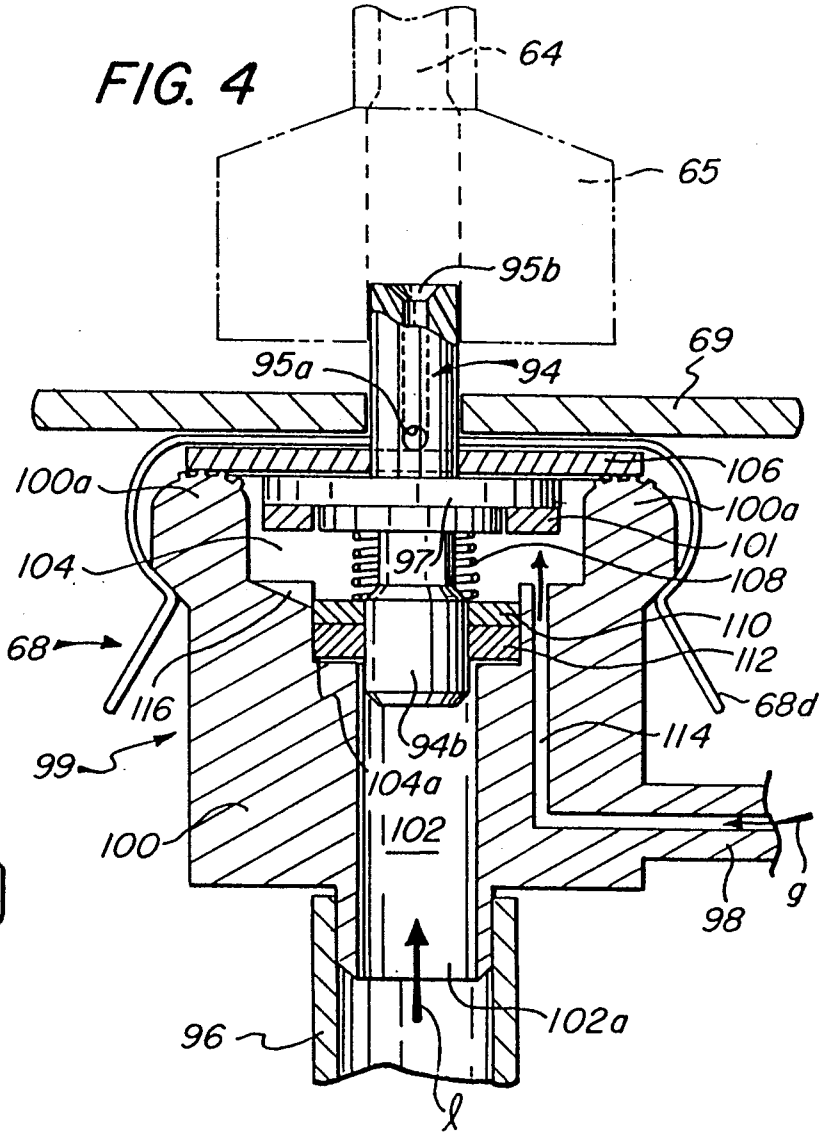
FIG. 4 is a cross sectional view in elevation of a dual-acting valve utilizable in the fuel container of FIG. 3, showing the valve in its fully closed position.
Figures 4A, 4B, 4C:
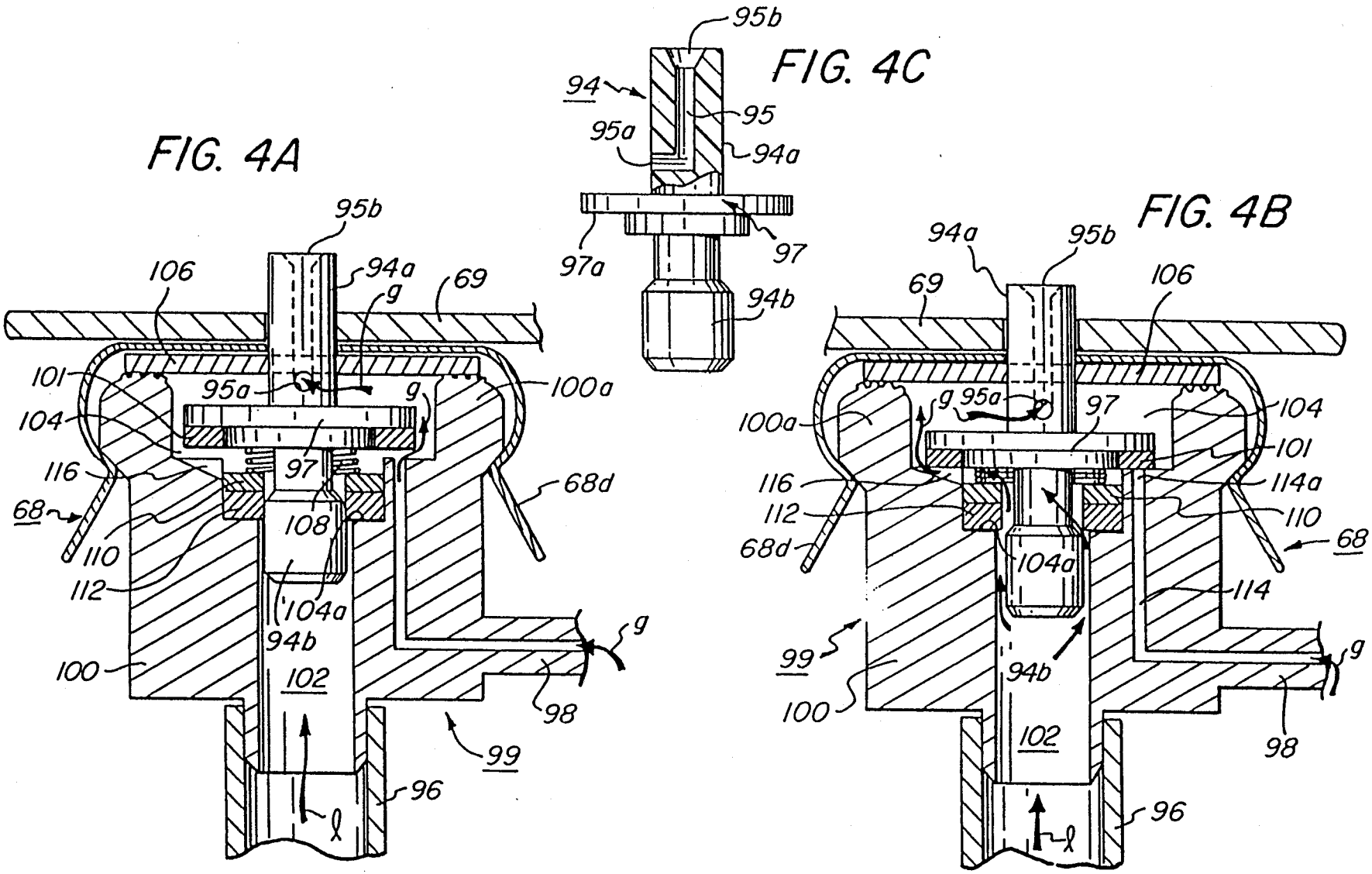
FIG. 4A is a view corresponding to FIG. 4 but showing the valve in its gas-dispensing position.
FIG. 4B is a view corresponding to FIG. 4 but showing the valve in its liquid-dispensing position.
FIG. 4C is an elevation view, partly in cross-section, of the valve stem component of the valve of FIG. 4.

FIGS. 4, 4A and 4B illustrate an embodiment of the dual-acting valve schematically illustrated in FIG. 3. Inlet nozzle 65 and a portion of supply conduit 64 are shown in dot-dash outline in FIG. 4, but are omitted from FIGS. 4A and 4B for simplicity of illustration.

Referring now to FIG. 4, the dual acting valve 99 comprises a valve body 100 having a central bore 102 extending therethrough. The inlet portion of bore 102 projects outwardly from body 100 to define a mounting leg 102a on which dip leg 96 (see FIG. 3) is mounted. Central bore 102 extends into a cup-shaped discharge chamber 104 which is configured to have a recessed, cylindrical seat portion 104a adjacent the entry of bore 102 into discharge chamber 104. A seat ring 110 and a seat gasket 112 are received within seat portion 104a. A valve stem 94 is slidably mounted within central bore 102 and, as best seen in FIG. 4D, comprises a stem portion 94a and a seat portion 94b which is of larger diameter than stem portion 94a. A mounting cup 97 has a recessed shoulder portion 97a and is affixed to stem portion 94a so that mounting cup 97 moves with stem valve 94. A shoulder gasket 101 is affixed to the recessed shoulder portion 97a of mounting cup 97. An L-shaped discharge conduit 95 is formed in stem portion 94a and includes a discharge inlet opening 95a in a lateral sidewall of stem portion 94a, and a discharge outlet opening 95b in the top of stem portion 94a.

Valve body 100 has a shoulder portion 100a on top of which is received a sealing gasket 106 which is compressed between the top of shoulder 100a, which has concentric sealing lips (unnumbered) formed in the top thereof, and an overlying, turned-over portion of neck portion 68d of pressure-resistant container 68. The upper portion of stem portion 94a protrudes through a circular opening in sealing gasket 106 and in the turned-over portion of neck portion 68d. A coil spring 108 surrounds stem portion 94a between mounting cup 97 and seat portion 94b and is contained between mounting cup 97 and seat ring 110. Seat ring 110 and seat gasket 112 are each of flat, annular configuration, having a central opening which is dimensioned and configured to slidably and seatably engage seat portion 94b of valve stem 94. Propellant gas line 98 is in flow communication with a propellant gas passage 114, which extends through body 100, and terminates in outlet 114a, in flow communication with discharge chamber 104.

A plurality of liquid flow passages 116 (only one of which is shown in FIGS. 4–4B) are formed about the shoulder of discharge chamber 104. Passages 116 are in the form of recessed ramps cut into the shoulder, to admit liquid from seat portion 104a to discharge chamber 104, by admitting the liquid beneath and around shoulder gasket 101 when the valve is in the position shown in FIG. 4B. Passages 116 are spaced from outlet 114a of propellant gas passages 114, so that shoulder gasket 101 can seal off outlet 114a when the valve is in the position of FIG. 4B.

The valve 99 is shown in its closed position in FIG. 4, the flow of liquid, indicated by arrow 1, upwardly through dip-leg 96 being blocked by seat portion 94b closing the central opening of seat ring 110 and seat gasket 112. Similarly, the flow of gas from gas space G' as indicated by the arrow g can proceed no further than discharge chamber 104, because access to discharge inlet opening 95a is blocked by mounting cup 97 being seated against sealing gasket 106. The dual-acting valve means is thus in the fully closed position in FIG. 4, which corresponds to the position of fuel container 68 rendered in solid outline in FIG. 3.

There is sufficient play provided in retaining bar 90 so that, when it is desired to start operation of the stove, container 68 may be moved rightwardly as viewed in FIG. 3 to advance it relative to valve stem 94, which is retained in a fixed position by its engagement with inlet nozzle 65, so that discharge inlet opening 95a is moved to within discharge chamber 104, as illustrated in FIG. 4A. In this position of FIG. 4A, spring 108 is partly compressed relative to its position as illustrated in FIG. 4, but seat portion 94b is still received within the central aperture of seat gasket 112 thereby blocking passage of liquid into discharge chamber 104. However, pressurized gas flows, as indicated by the arrows g, into and through discharge chamber 104, into discharge outlet opening 95*a* thence through discharge conduit 95 and via inlet nozzle 65 into supply conduit 64. During this stage of operation, gas is flowed through conduit 64 and its heat exchange section 64*a* (FIG. 3) and through mixing cone 48', within which it is mixed with air entering air openings 48*a'*, to form a combustion mixture. (Heat exchange section 64*a* is configured similarly to heat exchange section 12*b* of the FIGS. 1 and 2 embodiment, comprising serpentine loops or coils formed in conduit 64.) The combustion mixture is ignited within combustion zone 80, as by utilization of igniter 50'. As combustion proceeds, supplementary combustion air may be aspirated through air inlet 48*b''*. As is also the case with the FIG. 1 embodiment, air gates (not shown) may be mounted relative to inlets 48*b''* to selectively close them or adjust the effective flow area of their openings in order to adjust the amount of combustion air introduced. Alternatively or additionally, similar flow constricting means may be provided adjacent air openings 48*a'* to adjust the amount of combustion air introduced into combustion zone 80.

As combustion proceeds, heat exchange section 64*a* of inlet conduit 64 is heated to an elevated temperature and, when it attains a sufficiently high temperature, liquid fuel is introduced therein for vaporization to form a fuel vapor and the flow of the flammable propellant gas, as such, is discontinued. (To the extent that the propellant gas is soluble in the liquid fuel, dissolved gas in the liquid fuel will of course also vaporize in heat exchange section 64*a* and form part of the combustion mixture introduced into combustion zone 80.) However, the direct introduction of gas from gas space G' is usually discontinued after the initial cold start period, in which the propellant gas provides the fuel for combustion.

The subsequent stage of operation, i.e., the use of the liquid fuel for combustion and the cessation of flow of the propellant gas, as such, into combustion zone 80, is effectuated by shifting fuel container 68 rightwardly as viewed in FIG. 3 to the position indicated by the dash line rendition of base rim 68*b* and positioning collar 69. Although such movement may be effectuated manually after a stated time interval, it is convenient to have such action take place automatically upon attaining a predetermined temperature within combustion zone 80. Thermal expansion/contraction device 82 and its associated push rod 86 and retaining bar 90 serve this purpose. As the temperature increases within combustion zone 80, thermal expansion/contraction device 82 expands, thereby moving push rod 86 leftwardly as viewed in FIG. 3, and thereby pivoting retaining bar 90 to the position shown in dash outline in FIG. 3. This permits the action of coil spring 72 to move container 68 rightwardly, to the position shown in FIG. 4B, in which mounting cup 97 is seated against the shoulder portion of discharge chamber 104, thereby sealing the outlet 114*a* of propellant gas passage 114 against the flow of further gas therethrough.

As illustrated in FIG. 4B, seat portion 94*b* of valve stem 94 is displaced from the central opening of annular shaped seat ring 110 and seat gasket 112 so that liquid, under the pressure imposed upon it by the superatmospheric gas contained within gas space G', flows as indicated by the arrows 1 through the annular space between seat portion 94*b* and the walls of central bore 102, thence through the liquid flow passages 116 into discharge chamber 104, thence into discharge inlet opening 95*a* and via discharge outlet opening 95*b* into inlet nozzle 65 and then supply conduit 64. The flow of liquid fuel thus replaces the flow of flammable propellant gas after the initial cold start period, and the liquid fuel is vaporized within heat exchange section 64*a* so that a resultant fuel vapor is transported into combustion zone 80 for combustion therein. A suitable valve (not shown) may be interposed at an appropriate position within supply conduit 64 when it is desired to turn off the stove. As the stove cools, thermal expansion/contraction means or device 82 will contract, forcing container 68 leftwardly to the position shown in FIG. 3.

Container 68 may be positioned manually and a suitable indicia means may be provided on mounting bracket 70 to indicate the proper positioning of the container corresponding to the valve positions illustrated in FIGS. 4, 4A and 4B. Alternatively, or in addition, a positioning knob or other suitable means may be provided to effectuate a manual positioning of the container corresponding to selected ones of the valve positions illustrated in FIGS. 4, 4A and 4B. A suitable mechanical stop means may also be provided to hold container 68 in the desired position, and/or to override the thermal expansion/contraction device 82, if desired.

It will be observed that in order to operate properly, container 68 must be positioned within mounting bracket 70 with the proper orientation to provide the dip-leg 96 oriented into the liquid (downwardly as viewed in FIG. 3) and to provide the propellant gas line 98 oriented into the gas space G' (upwardly as viewed in FIG. 3). This is readily accomplished by providing positioning collar 69 with a cut-out or notch 69*a* (FIG. 3B) therein in order to engage a positioning block 73 (FIG. 3C) which is affixed to base 70*b* of mounting bracket 70. Positioning block 73 has a wedge-shaped portion 73*a* which is dimensioned and configured to slidably receive positioning cut-out 69*a* thereon, as best seen in FIG. 3. Wedge-shaped portion 73*a* is long enough to accommodate sliding movement thereover of positioning cut-out 69*a* as container 68 is shifted rightwardly and leftwardly as viewed in FIG. 3 among the valve positions illustrated in FIGS. 4, 4A and 4B. Positioning block 73 has a stop-block 73*b* portion thereof which limits the rightward (as viewed in FIG. 3) movement of container 68.

As with the FIG. 1 embodiment, numerous useful features such as a housing to contain body portion 76 and thermally insulate it from its surroundings, and support or enclosure means for bracket 70 or its equivalent, have been omitted from FIG. 3 for simplicity of illustration. Among such features could be means to support and retain supply conduit 64 and inlet nozzle 65 in position, as container 68 is shifted relative thereto.

Generally, the flammable propellant is any suitable normally gaseous propellant which will form a combustion mixture with air and can be combusted in the device to provide sufficient heat to vaporize the liquid fuel. The propellant is maintained under pressure within the fuel container, which may be a conventional aerosol container. Under such conditions, part or all of the propellant may be liquified and/or dissolved in the liquid fuel. In embodiments of the invention such as that illustrated with respect to FIG. 1, substantially all the propellant may be liquified, either by being dissolved in the liquid fuel or by liquifying under the superatmospheric pressure within the container, or both. When the valve stem on the pressure-resistant aerosol container is open, the combined propellant and liquid fuel is passed to a lower pressure zone, e.g., to an atmospheric pressure zone, and the propellant evaporates to provide a gas or vapor which may conveniently be combusted. In embodiments of the invention such as that illustrated with respect to FIG. 3, wherein a portion of the propellant gas itself is transported to the combustion zone during the cold start period, the conditions and propellant are selected so that at least a substantial portion of the propellant remains in the gaseous state within the container. Reference herein and in the claims to a "normally" gaseous propellant and a "normally" liquid fuel means that the respective gaseous and liquid states exist at ambient temperature (70° F.) and atmospheric pressure.

The pressure at which the fuel and propellant are maintained within the pressure-resistant aerosol container may vary, depending upon the rating of the container used and the particular combination of fuel and propellant utilized. Generally, aerosol containers rated 2Q have a burst strength of 210 pounds per square inch gauge ("psig"), those rated 2P have a burst stength of 180 psig and unrated aerosol containers have a burst strength of 140 psig. Aerosol production lines usually fill the containers to not more than about 35 psig at 70° F.; it is accepted practice to fill the containers to a pressure which will provide a pressure within the can of not more than two-thirds of the rated burst strength when the contents are at a temperature of 130° F.

The practices of the present invention are utilizable within any suitable fuel and propellant combination. A fuel such as kerosene or other hydrocarbon based fuel may be used. However, because of their low toxicity, explosion hazard, and water extinguishability, alcohols are preferred fuels. Among suitable alcohol fuels are one or more of methanol, ethanol, propanol and isomers of propanol such as isopropyl alcohol. Other suitable alcohols may be employed. Among preferred propellants are normally gaseous hydrocarbons such as one or more of methane, ethane, butane, isobutane, propane, isopropane and dimethylethylene. Other suitable flammable propellants, i.e., propellants which form a combustion mixture with air, may be utilized.

The stove or other combustion device made in accordance with the practices of the present invention will find use in a variety of applications including use on board boats or ships, camping or other outdoor use such as military activities. For use at extremely cold temperatures at which the vapor pressure of the normally gaseous hydrocarbon might be so far reduced as to render it ineffective for discharging fuel from the container at an adequate rate, it may be desired to incorporate a low boiling gas in the propellant. The low boiling gas may itself be flammable or it may be a non-flammable gas such as carbon dioxide. Thus, the used of a low boiling flammable propellant such as methane or ethane will provide excellent extreme low temperature utility, or if it is desired to use somewhat higher boiling propellants, such as propane, a sufficient proportion of a low boiling gas may be added to the relatively high boiling propellant to increase its vapor pressure and provide an adequate rate of discharge of fuel from the container. Thus, hydrogen, carbon dioxide, nitrous oxide, methane, and/or ethanol, to name a few such gases, may be added to the propellant to provide extreme low temperature utility for the pressurized fuel. Generally, the use of a gas whose boiling point at atmospheric pressure is not higher than about minus 60° F. may be utilized. For extreme cold temperature use, such as in Arctic or Antarctic conditions, an even lower temperature boiling gas, one having a boiling point at atmospheric pressure of not more than about minus 90° F., may be utilized.

The proportion of propellant to liquid fuel may vary widely. If the fuel container is going to be utilized in a situation in which the combustion device or stove will be turned on and shut off repeatedly, a somewhat higher proportion or propellant to liquid fuel may be desired. Generally, as a practical matter the propellant should provide at least about 3 percent by weight of the combined weight of fuel plus propellant. There is no theoretical upper limit on the proportion of propellant relative to liquid fuel in terms of utility, but as a practical matter, if it is desired to use a fuel such as alcohol because of its low flammability and water extinguishability, then the amount of flammable propellant which should be included is limited by considerations of flammability, explosion hazard, etc. With a low enough proportion of flammable propellant, the combined propellant and liquid fuel will readily meet insurance and safety standards of associations such as the National Fire Prevention Association. Thus, the propellant may comprise from about 3 percent to 50 percent by weight, preferably from about 3 percent to 30 percent by weight, of the combined weight of fuel plus liquid propellant, with the fuel comprising from about 50 to 97 percent by weight, preferably from about 70 to 97 percent by weight of the combined fuel and propellant. A particularly preferred combination of liquid fuel and propellant is a normally liquid alcohol and a normally gaseous hydrocarbon, e.g., an alcohol selected from one or more of methanol, ethanol and isopropyl alcohol and a propellant selected from propane or a mixture of hydrocarbon gases predominantly comprising propane. Such a mixture may comprise, for example, from 3 to 10 percent by weight propane or predominantly propane propellant gases, say 5 percent by weight propane, and 90 to 97 percent by weight of the alcohol, say 95 percent by weight alcohol.

While the invention has been described in detail with respect to its specific preferred embodiments thereof, it will be apparent that, upon a reading and understanding of the foregoing, variations thereto will readily occur to those skilled in the art which variations are nonetheless believed to lie within the spirit and scope of the appended claims.

What is claimed is:

1. A method for combusting a pressurized fuel, the method comprising:

(a) providing a pressurized fuel mixture comprised of a normally liquid fuel and a flammable, normally gaseous propellant which is at least sufficiently soluble in the normally liquid fuel to provide a flammable gas as defined below;

(b) at least during a cold start period, (i) passing the pressurized fuel mixture to a reduced pressure zone to therein vaporize propellant from the fuel mixture to provide therefrom a flammable gas separated from the fuel mixture, (ii) mixing the resultant separated flammable gas with combustion air to provide a start-up combustion mixture, and (iii) combusting the start-up combustion mixture in a combustion zone;

(c) passing the pressurized fuel mixture to a heat exchange zone and heating it therein to vaporize the normally liquid fuel and provide therefrom a fuel vapor and, at least during the cold start period, using heat obtained from step (b) (iii) for thus heating the liquid fuel; and (d) mixing the fuel vapor with combustion air to provide a primary combustion mixture, and combusting the primary combustion mixture in the combustion zone.

2. The method of claim 1 wherein the liquid fuel comprises an alcohol and the propellant comprises a normally gaseous hydrocarbon.

3. A method for combusting a pressurized fuel, the method comprising:

(a) providing a pressurized fuel mixture comprised of a normally liquid fuel and a flammable, normally gaseous propellant at least part of which is maintained as a gas at superatmospheric pressure within a gas space to pressurize the liquid fuel;

(b) at least during a cold start period, (i) passing a portion of the propellant but not the liquid fuel to a combustion zone, (ii) mixing the passed propellant but not the liquid fuel with combustion air to provide a start-up combution mixture, and (iii) combusting the start-up combustion mixture in a combustion zone;

(c) passing the liquid fuel to a heat exchange zone and heating it therein to vaporize the normally liquid fuel and provide therefrom a fuel vapor and, at least during the cold start period, using heat obtained from step (b) (iii) for thus heating the liquid fuel; and (d) mixing the resultant fuel vapor with combustion air to provide a primary combustion mixture, and combusting the primary combustion mixture in the combustion zone.

4. The method of claim 3 wherein the liquid fuel comprises an alcohol and the propellant comprises a hydrocarbon.

5. The method of any one of claims 1, 2, 3 or 4 including, subsequent to the cold start period, using heat obtained from combusting the primary combustion mixture to vaporize the liquid fuel.

6. The method of any one of claims 1, 2, 3 or 4 including providing a pressurized fuel mixture comprised of a major proportion of alcohol as the liquid fuel and a minor proportion of the propellant.

7. The method of claim 6 including providing a normally gaseous hydrocarbon as the propellant.

8. The method of claim 7 wherein the pressurized fuel mixture comprises from about 50 percent to about 97 percent by weight alcohol and from about 50 percent to about 3 percent by weight of the hydrocarbon.

9. The method of claim 7 wherein the alcohol is selected from the class consisting of one or more of methanol, ethanol, propanol and isomers of propanol, and the hydrocarbon is selected from the class consisting of one or more of methane, ethane, butane, isobutane, propane, isopropane and dimethylethylene.

10. The method of any one of claims 1, 2, 3 or 4 wherein the propellant has a boiling point not higher than about minus 60° F. at one atmosphere pressure.

11. The method of claim 10 wherein the propellant is selected from the class consisting of carbon dioxide, nitrous oxide, hydrogen, methane and ethane.

* * * * *